US006055011A

United States Patent [19]

Nishimura

[11] Patent Number: 6,055,011

[45] Date of Patent: Apr. 25, 2000

[54] IMAGE PROCESSING APPARATUS WHICH PERFORMS DENSITY CONTROL FOR EACH OF PLURAL COLORS OF RECORDING MATERIAL

[75] Inventor: Ken Nishimura, Susono, Japan

[73] Assignee: Canon Kabushiki Kaisha, Tokyo, Japan

[21] Appl. No.: 08/766,882

[22] Filed: Dec. 13, 1996

[30] Foreign Application Priority Data

Dec. 18, 1995 [JP] Japan ..... 7-329288

[51] Int. Cl.[7] ..... G03G 15/10

[52] U.S. Cl. ..... 347/254

[58] Field of Search ..... 347/19, 16, 131, 347/240, 251, 254; 358/298; 399/59, 60, 74

[56] References Cited

U.S. PATENT DOCUMENTS 5,678,132 10/1997 Shiba et al. ..... 399/59

5,736,996 4/1998 Takada et al. ..... 347/19

*Primary Examiner*—N. Le

*Assistant Examiner*—Michael Nghiem

*Attorney, Agent, or Firm*—Fitzpatrick, Cella, Harper & Scinto

[57] ABSTRACT

When tone correction is performed by forming a tone patch and measuring density thereof, a contrast processing method used for Bk toner is applied to color toner patches (Y, M and C) to obtain relative density free from any influence of a background. More specifically, density of a predetermined standard gray chart is first measured by a density sensor, the measured value of the gray chart is then substituted into an equation expressing Bk toner density, and a constant of the density sensor is obtained by the least square method. By applying the obtained constant of the density sensor to an equation expressing color toner density, relative density of color toners to background density is obtained in a manner similar to that for the Bk toner.

7 Claims, 7 Drawing Sheets

IMAGE PROCESSING APPARATUS WHICH PERFORMS DENSITY CONTROL FOR EACH OF PLURAL COLORS OF RECORDING MATERIAL

BACKGROUND OF THE INVENTION

The present invention relates to an image processing apparatus and method thereof, and more particularly, to an image processing apparatus and method thereof which utilizes plural colors of recording material such as toner and performs density control for each of the color recording material such as toner.

When color image formation is performed by an image processing apparatus employing the conventional electrophotographic printing method, along with changes in various conditions of image formation, e.g. operational environment or printing quantity, a level of image density outputted in response to an inputted image signal changes. Therefore, an output image does not always present an original color tonality represented by an inputted image signal.

To cope with the above situation, a method has been proposed in the conventional image processing apparatus where a toner image (hereinafter referred to as a patch) used for detecting density of each color is experimentally formed on a photosensitive drum or an intermediate transfer member in order to determine density reproducibility in image formation. Density of the patch is then automatically detected by a density sensor, feeding back the detection result of image formation conditions e.g., quantity of exposure, developing bias or the like, to perform density control so that the color image is formed in a color tonality consistent with the original image, thereby obtaining a desirable color image output.

In most cases, a conventional density sensor is embodied e.g. near an intermediate transfer member.

FIG. 6 is a drawing which shows an arrangement of a density sensor. Hereinafter, descriptions will be provided for the arrangement of the density sensor with reference to FIG. 6.

In FIG. 6, reference numeral 102 denotes a light-emission device such as an LED or the like; and 101, a photoreceptor such as a pin-type photodiode or the like. In this example, an infrared LED is utilized as a light-emission device 102, which irradiates an infrared ray on Y, M, C and Bk toner formed on an intermediate transfer member 105, such as those indicated by reference numeral 105A and 105B. The reflected light is then detected by the photoreceptor 101 and converted to an electric signal. The light-emission device 102 and photoreceptor 101, which constitute the density sensor, are arranged at different angles with respect to the intermediate transfer member 105 as shown in FIG. 6. The photoreceptor 101 is configured for measuring diffused reflected light from the patch. The foregoing structure provides an advantage in that density of all colors (Y, M, C and Bk) of toner can be detected by a pair of the light-emission device 102 and photoreceptor 101. However it also has a disadvantage in that the output characteristic of the density sensor for a Y, M and C toner patch is different from that of a Bk toner patch. For this reason, different processing sequences are necessary for Y, M and C toner and for Bk toner, in order to convert an output of the density sensor into a density value.

Besides the above described configuration of the density sensor, it is also possible to comprise three colors of light-emission devices respectively corresponding to each spectrum of Y, M and C toner and corresponding photoreceptors, to detect the density of the respective patch. Such configuration provides an advantage in that the output characteristics for all four types of toner are the same. Therefore, only one type of processing sequence is necessary for converting an output of the density sensor into a density value. On the other hand, since three pairs of light-emission devices and photoreceptors are necessary, the production cost as well as the size of an apparatus increases. For this reason, such configuration is rarely adopted as a density sensor of a color image processing apparatus.

As a series of printing processes according to the electrophotographic printing method is executed, sometimes the surface of the intermediate transfer member 105 in the image processing apparatus becomes rough, as caused by a cleaning unit, provided to remove remaining toner from the surface, or an edge of a transferring material e.g., a print sheet or the like, scraping the surface or contacting with the surface of the intermediate transfer member. Moreover, sometimes toner scattering inside the apparatus adheres on the surface of the intermediate transfer member 105. As a result, intensity of the reflected light from the density-measure patch detected by the density sensor deviates from that under the normal condition of an intermediate transfer member, thus normal density detection cannot be performed.

Furthermore, when the surface of the intermediate transfer member 105 is cleaned, all the remaining toner is not always completely removed, but accumulates gradually on the surface, causing a change in the color of the surface of the intermediate transfer member 105, thereby reducing the reflectivity thereof. As a result, the density detection result obtained by the density sensor is largely influenced by the reflectivity of the intermediate transfer member 105 on which toner still remains, and a measured density value changes as the apparatus is used for a long period of time.

FIG. 7 is a graph showing relationships of toner density and output of the density sensor, in the case where density of patches is measured at three positions A, B and C on the intermediate transfer member 105, at which each of the positions has a different reflectivity. According to FIG. 7, the reflectivity of the intermediate transfer member 105 decreases as the position moves from A to C. Note that in FIG. 7, a measurement result is shown with respect to M toner and Bk toner. Since the same measurement results are obtained for Y, M and C toner, M toner will represent the color toner herein and the results of Y and C toner are omitted.

As a contrast processing method employing the above described density sensor, the following method may be considered. When density detection is performed by the density sensor as described above, in order to cope with the problem in which a density detection result largley varies depending on the reflectivity of the surface of the intermediate transfer member 105 serving as a background, density with respect to Bk toner is measured at two positions: on the background and the toner patch, and a relative density is obtained. Hereinafter, the contrast processing method will be described.

Assuming that incident ray ($I_{o1}$) is irradiated on a background (density Du) where a patch is not formed and reflected ray ($I_{r1}$) is obtained. The relation is expressed by the following equation.

$$I_{r1}=I_{o1}\cdot 10^{-Du} \tag{1}$$

Next, assuming that when a patch having density Dp is formed on the background having density Du, incident ray ($I_{o2}$) is irradiated and reflected ray ($I_{r2}$) is obtained. The relation is expressed by the following equation.

$$I_{r2}=I_{o2}\cdot 10^{-(kDp+Du)} \quad (2)$$

Herein, k is a proportional coefficient depending on the type of toner and the configuration of the density sensor 2. The equation (2) is a theoretical equation expressing intensity of light detected by the density sensor 2 when light is irradiated on a toner (Bk toner) which shows an absorptive characteristic.

Herein, assuming that voltage values corresponding to the reflected light are $V_{ref1}$ and $V_{ref2}$ in equations (1) and (2) respectively, they are expressed by the following equations.

$$V_{ref1}=I_{o1}\cdot 10^{-Du} \quad (3)$$

$$V_{ref2}=I_{o2}\cdot 10^{-(kDp+Du)} \quad (4)$$

In order to calculate patch density Dp, the equation (3) is divided by equation (4) and the following equation (5) is obtained.

$$V_{ref1}/V_{ref2}=(I_{o1}/I_{o2})\cdot 10^{kDp} \quad (5)$$

Accordingly, the patch density Dp is calculated by the following equation (6).

$$kDp=\log(I_{o2}/I_{o1}\cdot V_{ref1}/V_{ref2}) \quad (6)$$

According to equation (6), density of Bk toner is expressed by detected voltages corresponding to the incident ray and reflected light respectively obtained from the background and toner patch. Therefore, by respectively measuring density at two positions on the background and toner patch, and dividing one measurement result by the other measurement result, a relative density to the background patch can be obtained for Bk toner. Accordingly, it is possible to evaluate density of Bk toner with which background density is removed.

When a relative density value of color toner patch (Y, M and C) is to be calculated in the similar manner as the Bk toner according to the contrast processing method, a processing sequence different from that of the above described Bk toner patch is necessary. In this case, the following problem arises and density detection is difficult. Hereinafter, the problem will be described in detail.

Assuming that incident ray ($I_{o1}$) is irradiated on a background (density Du) where a patch is not formed and reflected ray ($I_{r1}$) is obtained. The relation is expressed by the following equation.

$$I_{r1}=I_{o1}\cdot(1-10^{-Du}) \quad (7)$$

Herein, reflectivity of a background is expressed as Ru and defined by the following equation.

$$10^{-RU}=1-10^{-Du} \quad (8)$$

With the above, the following equation can be obtained.

$$I_{r1}=I_{o1}\cdot 10^{-Ru} \quad (9)$$

Next, assuming that when a patch having density Dp is formed on the background having density Du, incident ray ($I_{o2}$) is irradiated and reflected ray ($I_{r2}$) is obtained. The relation is expressed by the following equation.

$$\begin{aligned} I_{r2} &= I_{o2}\{1-10^{-kDp}\cdot(1-10^{-Du})\} \quad (10) \\ &= I_{o2}\{1-10^{-kDp}\cdot 10^{-Ru}\} \\ &= I_{o2}\{1-10^{-(kDp+Ru)}\} \end{aligned}$$

In order to evaluate the patch density Dp, as similar to the above described case of Bk toner using the contrast processing method, if equation (9) is divided by equation (10) assuming that voltage values corresponding to the reflected light are $V_{ref1}$and $V_{ref2}$, a constant term Ru still remains. Thus, the patch density Dp cannot be expressed by the incident ray and detected voltage corresponding to the reflected light respectively obtained from the background and toner patch, as similar to the case of the Bk toner. In other words, the density (Dp) cannot be easily evaluated.

Therefore, it is necessary to obtain the patch density Dp and the background density Du from the equations (9) and (10) without performing the division, and obtain a relative density by subtracting the background Du from the patch density Dp. However in this case, incident ray intensity (Io) and a proportional coefficient (k) must be evaluated. Moreover, an absolute method of measuring the incident ray intensity (Io) is not established. Accordingly, there has been no appropriate method suggested for the contrast processing method which is utilized to measure relative density of Y, M, C color toners, leaving various problems to be solved.

SUMMARY OF THE INVENTION

The present invention has been made in consideration of the above situation, and has as its object to provide an image processing apparatus and method thereof which is capable of image formation in a stable manner by always performing accurate density detection without being influenced by variation of density on the surface of an image bearing member.

It is another object of the present invention, in an image processing apparatus which performs image formation by utilizing color recording material and black recording material, to appropriately evaluate a relative density for color recording material and black recording material in a respective processing sequence.

It is still another object of the present invention to obtain accurate characteristics of density detection means to enable correction of the characteristics in order to perform accurate density detection.

According to one aspect of the present invention, the foregoing objects are attained by providing an image processing apparatus comprising: image forming means for forming a color image using color recording material and black recording material in accordance with an inputted color image signal; generation means for generating image data of a reference density pattern; density detection means for detecting density of a pattern image formed on the basis of the image data of the reference density pattern; and control means for controlling an image forming condition of the image forming means in accordance with a density value detected by the density detection means, wherein the density detection means detects density of the pattern image formed with the color recording material as relative density to background density.

According to the preferred embodiment of the present invention, the density detection means includes: a density sensor for irradiating light on the pattern image and detecting reflected-light from the pattern image; and relative density evaluation means for evaluating the density of the pattern image as the relative density to the background density in accordance with reflected-light information outputted from the density sensor.

According to the preferred embodiment of the present invention, the relative density evaluation means evaluates relative density by removing background information of the pattern image from the reflected-light information outputted from the density sensor.

According to the preferred embodiment of the present invention, the relative density evaluation means obtains light-reflection characteristic of each color of the color recording material based on a light-reflection characteristic of a predetermined pattern image, and removes the background information of the pattern image from the reflected-light information outputted from the density sensor in accordance with the light-reflection characteristic of each color.

According to the preferred embodiment of the present invention, the predetermined pattern image is a pattern image having a predetermined density formed with black recording material.

According to the preferred embodiment of the present invention, a characteristic of the density sensor at the time of generating the predetermined pattern image is obtained in advance and stored.

According to the preferred embodiment of the present invention, the light-reflection characteristic is a ratio of reflected light intensity to incident ray intensity in the pattern image.

According to the preferred embodiment of the present invention, the color recording material includes any of yellow, magenta and cyan.

Moreover, the preferred embodiment of the present invention includes a pattern image area having a predetermined density which is established in an area where the recording material does not adhere, wherein the density detection means corrects the evaluation of the relative density evaluation means in accordance with a result of density detection in the pattern image area.

According to the preferred embodiment of the present invention, the density detection means corrects a parameter used in the relative density evaluation means in accordance with the result of density detection in the pattern image area.

According to the preferred embodiment of the present invention, the pattern image area having the predetermined density comprises a pattern image formed with color recording material.

According to another aspect of the present invention, the foregoing object is attained by providing an image processing apparatus including image forming means for forming an image on an image bearing member comprising: input means for inputting density pattern image data obtained by reading a density pattern formed on the image bearing member in accordance with reference density pattern data, and background image data indicative of background density of the image bearing member; and generation means for generating tone correction data corresponding to each recording material by utilizing a different processing sequence for black recording material and color recording material used by the image forming means, in accordance with relative density of a density pattern to the background density obtained on the basis of the background image data and the density pattern image data.

According to the preferred embodiment of the present invention, in the processing sequence for color recording material, the relative density is evaluated utilizing a sensor constant and a toner constant.

According to the preferred embodiment of the present invention, the toner constant is different for each type of recording material.

According to the preferred embodiment of the present invention, the toner constant and the sensor constant are evaluated in advance and stored.

According to another aspect of the present invention, the foregoing object is attained by providing an image processing apparatus comprising: an image bearing member on which a printing area and a non-printing area exist; forming means for forming a density pattern on the image bearing member in accordance with a reference density pattern; detection means for detecting density of the density pattern formed on the image bearing member; and generation means for generating tone correction data in accordance with the detected density, wherein density in the non-printing area is detected by the detection means and a characteristic of the detection means is evaluated in accordance with the detected density.

According to the preferred embodiment of the present invention, the reference density pattern is formed on the printing area.

According to still another aspect of the present invention, the foregoing object is attained by providing an image processing method used in an image processing apparatus which forms a color image, based on an inputted color image signal, using color recording material and black recording material comprising the steps of: generating image data of a reference density pattern; detecting density of a pattern image formed on the basis of the image data of the reference density pattern; and controlling an image forming condition in accordance with a detected density value, wherein when the density is detected, density of the pattern image formed with the color recording material is detected as relative density to background density.

According to still another aspect of the present invention, the foregoing object is attained by providing an image processing method of forming an image on an image bearing member of an image formation unit, comprising the steps of: inputting density pattern image data obtained by reading a density pattern formed on the image bearing member in accordance with reference density pattern data, and background image data indicative of background density of the image bearing member; and generating tone correction data corresponding to each recording material by utilizing a different processing sequence for black recording material and color recording material used in the image formation unit, in accordance with relative density of a density pattern to the background density obtained on the basis of the background image data and the density pattern image data.

According to still another aspect of the present invention, the foregoing object is attained by providing an image processing method comprising the steps of: forming a density pattern on an image bearing member having a printing area and a non-printing area, in accordance with a reference density pattern; detecting density of the density pattern formed on the image bearing member by a detection device; and generating tone correction data in accordance with the detected density, wherein density in the non-printing area is detected in the detection step and a characteristic of the detection device is evaluated in accordance with the detected density.

In an image processing apparatus which optimizes image forming conditions by generating a tone patch on an image bearing member for each color and measuring density thereof, the present invention is particularly advantageous since the contrast processing can be applied for color toner, as similar to the case of black toner, where a relative value of patch density to a background density is obtained. Thus, it is possible to always perform stable density detection for both black toner and color toner without being influenced by a condition of the surface of the image bearing member, whereby it is possible to obtain a high quality image output.

Further, according to the present invention, a relative density is appropriately evaluated for color toner and black toner in a respective processing sequence.

Furthermore, a reference density area for color toner is set on a non-printing area of the image bearing member and a sensor coefficient is corrected in accordance with a measured density value of the reference density area. By this, a characteristic of a density sensor can always be monitored and appropriately corrected; therefore stable density detection can be achieved taking time variation in the density sensor into consideration.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will be described in detail in accordance with the accompanying drawings.

Figure 1:
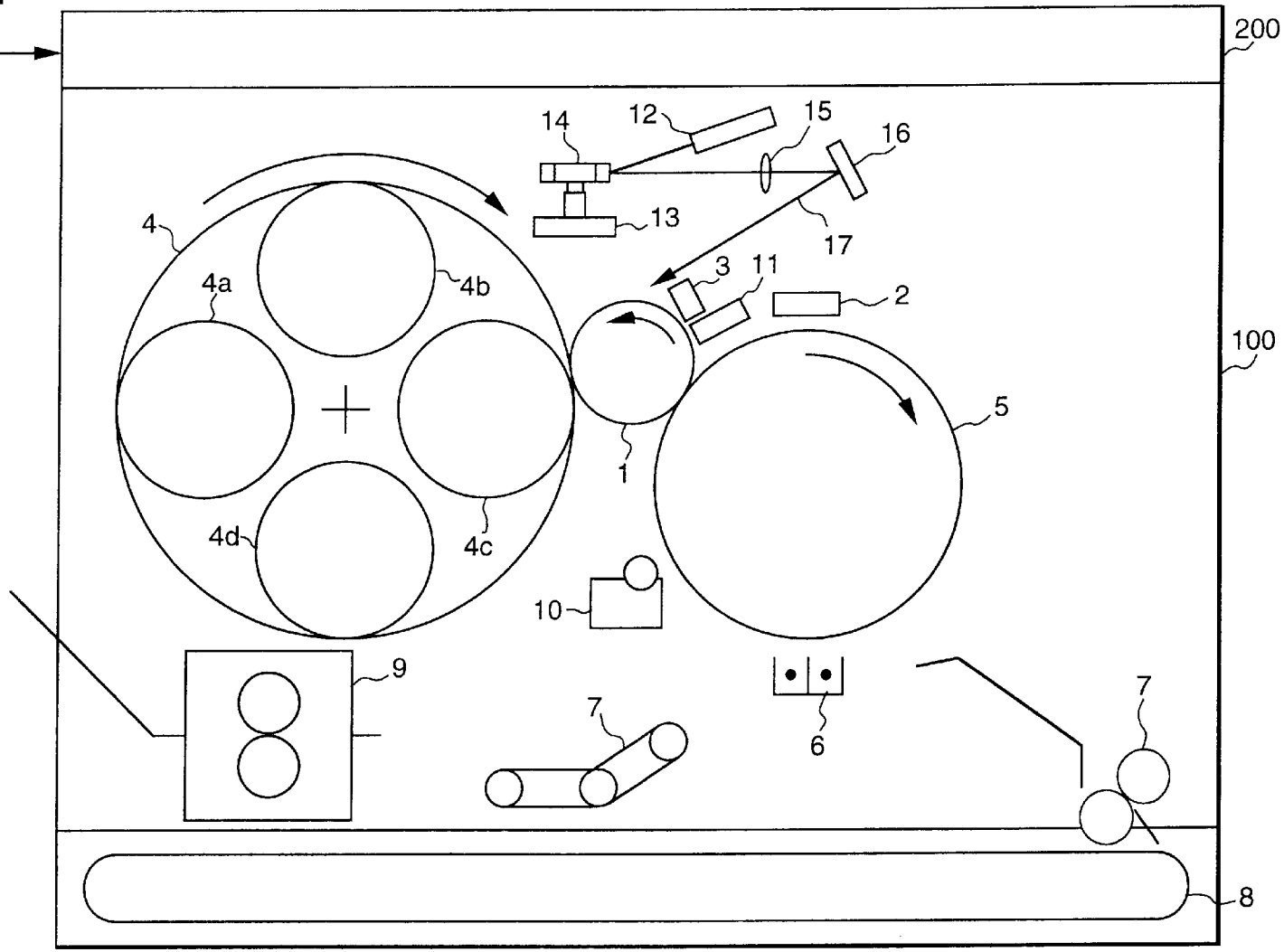
FIG. 1 is a sectional side view showing an internal arrangement of a color image processing apparatus which is a typical embodiment of the present invention.

FIG. 1 is a sectional view showing a color image processing apparatus 100 which is a typical embodiment of the present invention. In the color image processing apparatus 100 in FIG. 1, reference numeral 1 denotes a photosensitive drum; and 3, an electrostatic charger. A plurality of developers 4*a*, 4*b*, 4*c* and 4*d* arranged to the left of the photosensitive drum 1 are supported by a rotatable supporting body 4. In the foregoing structure, the photosensitive drum 1 is rotationally driven by a driver (not shown) in a direction indicated by an arrow.

The top portion of the inside of the apparatus includes a laser diode 12 which constitute an exposure unit, a polygon mirror 14 rotationally driven by a high-speed motor 13, a lens 15 and a reflection mirror 16.

When a signal according to image data representing the yellow (Y) color component is inputted in the laser diode 12, optical data corresponding to Y color component is irradiated on the photosensitive drum 1 through an optical path 17, and a latent image is formed. As the photosensitive drum 1 rotates in the direction of the arrow, the latent image is visualized by the toner 4*a*. The toner image on the photosensitive drum 1 is then transferred onto an intermediate transfer member 5 such as a transfer drum.

By consecutively performing the foregoing process for magenta (M), cyan (C) and black (Bk), a full-color image using plural colors of toner is formed on the intermediate transfer member 5. When the toner image having plural colors on the intermediate transfer member 5 arrives at a transfer position where a transfer electrostatic charger 6 is arranged, the toner image is transferred onto a printing medium, e.g. a print sheet or the like, which has been conveyed to the transfer position by this time. Note that the printing medium is stocked on a tray 8. The toner image on the surface of the printing medium is melted and fixed by a fixing unit 9 and a color image is obtained.

Meanwhile, the toner remained on the photosensitive drum 1 is cleaned by a cleaning unit 11 comprising a fur brush or a blade or the like. Also, the toner on the intermediate transfer member 5 is cleaned by a cleaning unit 10 for an intermediate transfer member which removes remaining toner by scraping the surface of the intermediate transfer member 5 using e.g. a fur brush or web or the like.

Note that in FIG. 1, reference numeral 2 denotes a density sensor for measuring density of a patch experimentally formed on the intermediate transfer member 5; and 200, an image signal processor for processing an input image signal from a host computer (not shown) which will be referred to as a host hereinafter. The density sensor 2 is an optical sensor and comprises an LED for irradiating light onto a patch and a pin-type photodiode for receiving reflected light from the patch.

Figure 2:
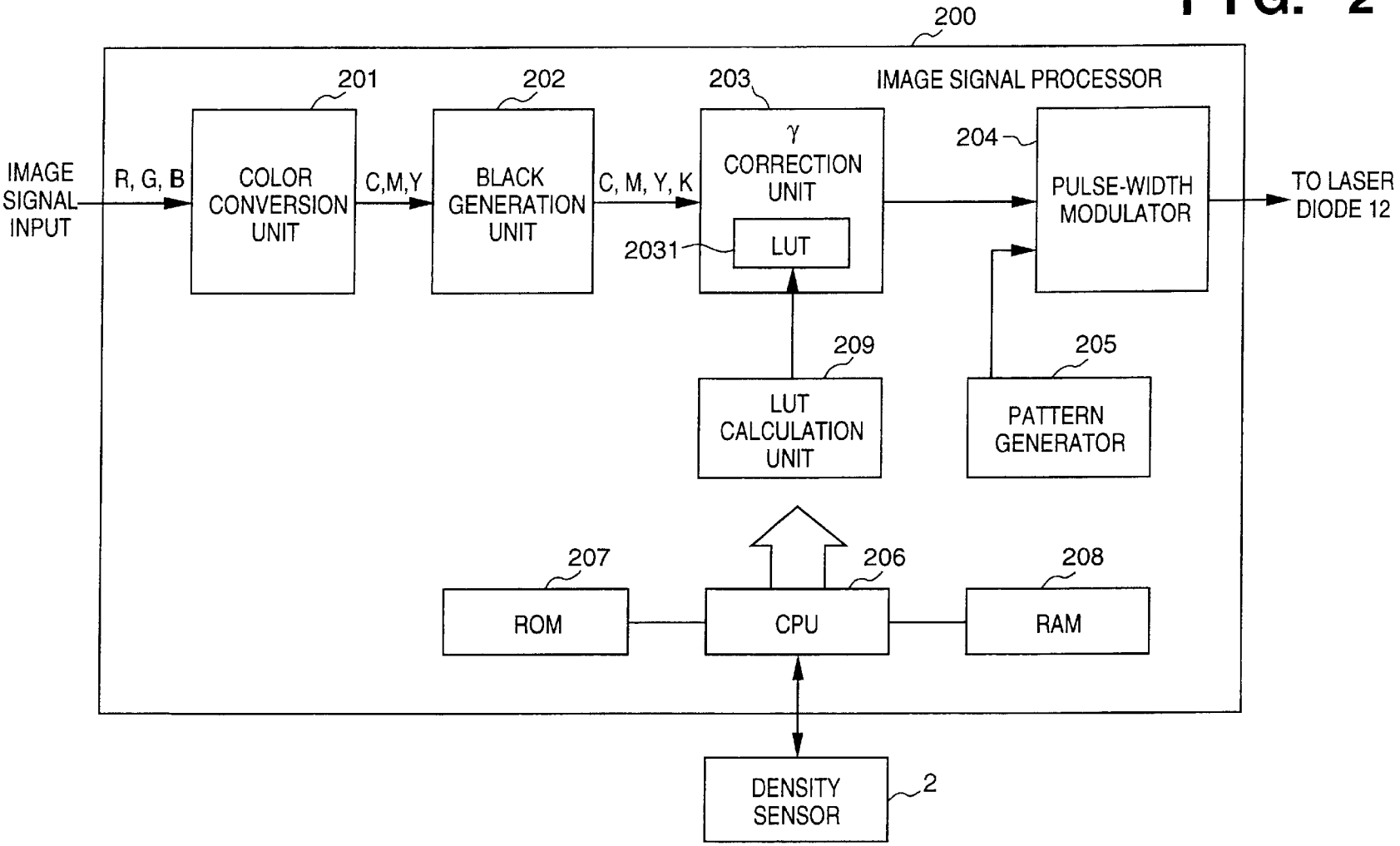
FIG. 2 is a block diagram showing an image signal processor in the color image processing apparatus shown in FIG. 1.

FIG. 2 is a block diagram showing an arrangement of the image signal processor 200 which performs image signal processing including density control. In FIG. 2, an image signal representing color data of R, G and B component inputted from the host is first subjected to a process of converting into C, M and Y signals in a color conversion unit 201. Then in a black generation unit 202, a Bk signal is generated from the C, M and Y signal. The C, M, Y and Bk signals generated in the above described manner is then subjected to density correction utilizing a LUT 2031 in a γ correction unit 203, and then to pulse-width modulation by a pulse-width modulator 204; and a driving signal for the laser diode 12 is generated.

Reference numeral 205 denotes a pattern generator for generating patch data of each color component (C, M, Y and K) used for density control. Reference numeral 209 denotes a LUT calculation unit where correction data to be set at the LUT 2031 inside the γ correction unit 203 is calculated by a CPU 206 on the basis of a density value detected by the density sensor 2, and contents of the LUT is updated in accordance with the calculated data. Reference numeral 206 denotes a CPU for controlling the image signal processor 200, which operates in a supervisory manner accordance with a control program stored in a ROM 207. Reference numeral 208 denotes a RAM utilized for a work area of the CPU 206. Note that the LUT 2031 may be included in the RAM 208.

The present embodiment is characterized in that toner patches for each of C, M, Y and K are formed by the density sensor 2 on the intermediate transfer member 5, and appropriate tonality correction is performed by accurately measuring density of the patches. Hereinafter, the density detection process according to the present embodiment will be described.

An outline of the process is as follows.

When, for instance, density correction is designated by an operation unit (not shown), patch data corresponding to yellow (Y) is generated by the pattern generator 205 in accordance with a designation from the CPU 206, and a patch A is formed on the surface of the photosensitive drum 1 utilizing Y toner. While the patch is formed, the density sensor 2 measures background density at the position where the patch A is to be transferred on the surface of the intermediate transfer member 5, and stores the output data in the RAM 208. The patch A is then transferred onto the intermediate transfer member 5, density thereof is measured by the density sensor 2, and the output data is stored in the RAM 208.

Next, a patch B is formed on the photosensitive drum 1 utilizing M (magenta) toner in a similar manner to the above described patch A. While the patch is formed, density sensor 2 measures background density at the position where the patch B is to be transferred on the surface of the intermediate transfer member 5, and stores the output data in the RAM 208. The patch B is transferred on a position different from the patch A on the intermediate transfer member 5, then density of the patch B is measured by the density sensor 2, and the output data is stored in the RAM 208.

Density of patches for C (cyan) and Bk (black), and background density of these patches are measured by the density sensor 2 in the same manner and the output data is stored in the RAM 208.

The output data of the density sensor 2 obtained in the above described manner is then converted to a relative density and to background density, in accordance with a processing sequence complying with the contrast processing method for color toner, which is the remarkable feature of the present embodiment. Hereinafter, the processing sequence will be described in detail.

Figure 3:
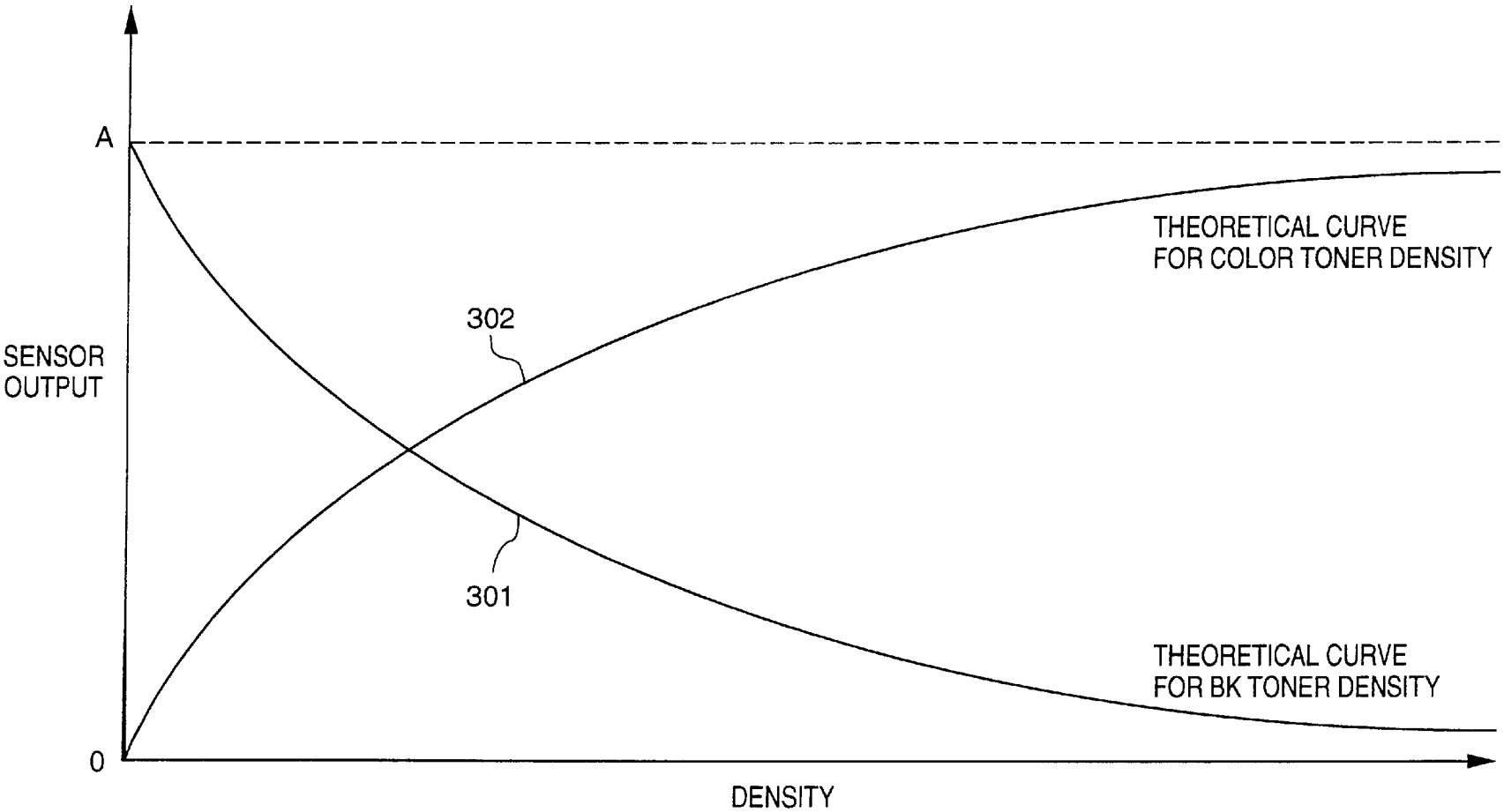
FIG. 3 is a graph showing a relationship between toner density and sensor output in the image processing apparatus shown in FIG. 1.

FIG. 3 is a graph showing density-sensor output curves according to equation (2) which expresses density at the time of measuring Bk toner patch, and equation (10) which expresses density at the time of measuring color toner patches as described above.

Based on equation (2), the relationship between incident ray intensity $I_{o1}$ and reflected ray intensity $I_{r1}$ for a curve 301 in FIG. 3 can be expressed as:

$$I_{r1}=I_{o1}\cdot 10^{-(kDp+Du)} \quad (2)'$$

Also, based on equation (10), the relationship between incident ray intensity $I_{o2}$ and reflected ray intensity $I_{r2}$ for a curve 302 can be expressed as:

$$I_{r2}=I_{o2}\{1-10^{-(kDp+Ru)}\} \quad (10)'$$

As shown in FIG. 3, while color toner has a higher output (intensity of reflected light) from the sensor in a high-density area, Bk toner has a low output from the sensor in the high-density area. Since color toner and Bk toner have different optical characteristics as exemplified in the graph, different processing sequences are necessary as mentioned above.

Assume that density measurement is performed for both the Bk toner patch and color toner patch. If both toner patches are measured by a density sensor having the same structure, since $I_{o1}$ is equal to $I_{o2}$, $I_{o2}$ in equation (10)' can be replaced with $I_{o1}$. Hereinafter, the value $I_{o1}$ is referred to as a sensor constant A and a reference letter k will be defined as a toner constant. Reflected ray intensity $I_{r1}$ and $I_{r2}$ can be substituted with output voltage of the density sensor 2, and will be referred to as $y_1$ and $y_2$ respectively. Density values of patches are assumed to be $x_1$ and $x_2$. Equations (2) and (10) are expressed in the following equation.

$$y_1=A\cdot 10^{-(kx1+Du)} \quad (11)$$

$$y_2=A\cdot\{1-10^{-(kx2+Ru)}\} \quad (12)$$

Note that the sensor constant A is a constant which indicates irradiation intensity depending on the characteristic of the light-emission device 102 of the density sensor 2. The toner constant k is different for each color (Y, M, C and Bk) and is dependent upon both the characteristic of each color toner and a characteristic of the sensor.

As described in the conventional example, when patch density (Dp) is to be evaluated as relative density (contrast), the constant term Ru remains in the case of the color toner, therefore the density cannot be evaluated utilizing the same technique as used to evaluate density for the Bk toner. In consideration of the above, in the present embodiment, the constant term Ru is estimated on the basis of equation (11) utilizing the least squares method, making it possible to apply the contrast processing method to color toner.

Figure 4:
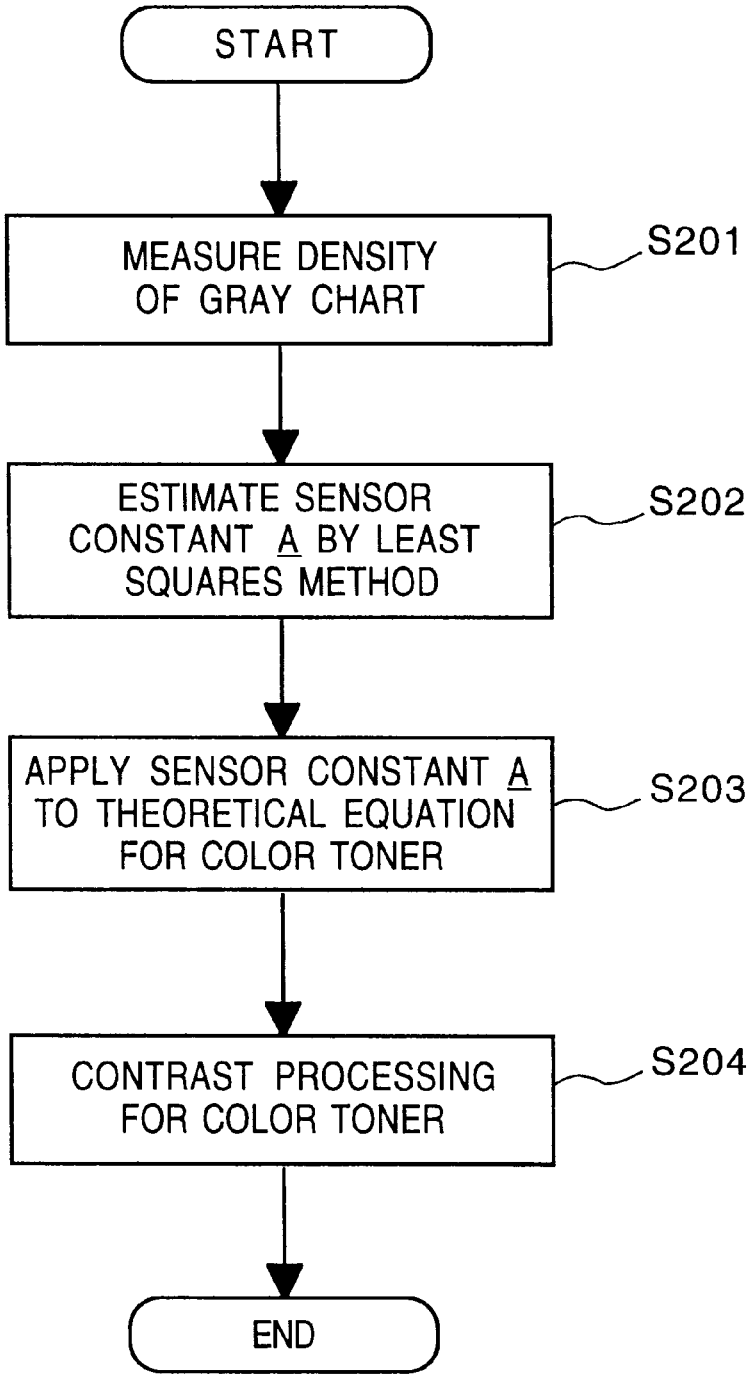
FIG. 4 is a flowchart showing steps of the contrast processing method for determining color toner density in the image processing apparatus shown in FIG. 1.

FIG. 4 is a flowchart showing a processing sequence in the case where the contrast processing method is applied to color toner. Hereinafter, the processing sequence will be described with reference to FIG. 4.

In step S201, density values at arbitrary points, e.g. at five or six points, in a reference standard gray chart are measured beforehand by a Macbeth density meter. The measured values are determined as reference density values (hereinafter referred to as Macbeth density). Note that since density of the reference chart is measured in step S201, background density is assumed to be "0" (Dp=0). Accordingly, when the equation (11) is applied to the gray chart, it is expressed as follows.

$$y_1=A\cdot 10^{-kxl} \quad (13)$$

Next, in step S202, the sensor constant A and toner constant k are estimated utilizing the least squares method, on the basis of equation (13) with the Macbeth density being $x_1$ and the sensor output voltage being $y_1$. That is, to estimate the values for the sensor constant A and toner constant k at the time of measuring the gray chart. In the above described manner, the sensor constant A and toner constant k are obtained. Note that since this process only needs to be completed by the time a manufactured apparatus is shipped, the measured values (sensor constant A and toner constant k) are stored in, e.g., the ROM 207.

In the foregoing manner, a part of coefficient (i.e., the sensor constant A) associated with equation (12) which expresses relative density of color toner, can be obtained utilizing equation (11) which expresses relative density of Bk toner.

In step S203, since the sensor constant A depends upon the structure of the density sensor 2, when the density sensor 2 having the same structure is utilized, the constant is utilized for measuring relative density of color toner. However, since the toner constant k depends upon the type of toner, the value of the toner constant k obtained for Bk toner cannot be simply substituted into equation (12) which expresses relative density of color toner. Herein, the following equation (14) can be obtained by modifying equation (12).

$$A-y_2=A\cdot 10-(kx2+Ru) \quad (14)$$

Herein, it is apparent from comparing the right side of the equation (14) and the right side of the equation (11) that both equations are expressed in the similar form of power. Therefore, the contrast processing method for obtaining relative density of Bk toner which has been described in the foregoing example can be applied.

More specifically, in step S204, the sensor constant A obtained in step S202 is substituted into the equation (14) and relative density to background density is obtained for color toner patch in accordance with the contrast processing method similar to that utilized for Bk toner.

Hereinafter, an example will be provided where the contrast processing method is applied to the calculation related to color toner. Assuming that incident ray $A_1$ is irradiated on a background (reflectivity Ru) where a patch is not formed and a detected signal $y_{21}$ is obtained by the density sensor 2, the relationship can be expressed by the following equation.

$$A_1-y_{21}=A_1\cdot 10^{-Ru} \quad (15)$$

Assuming that a patch having density $x_2$ is formed, incident ray $A_2$ is then irradiated, and a detected signal $y_{22}$ is obtained by the density sensor 2, the relationship can be expressed as follows on the basis of equation (13).

$$A_2-y_{22}=A_2\cdot 10^{-(kx2+Ru)} \quad (16)$$

In order to obtain the patch density $x_2$, equation (15) is divided by equation (16) resulting in the following equation.

$$(A_1-y_{21})/(A_2-y_{22})=(A_1/A_2)\cdot 10^{kx2} \quad (17)$$

Accordingly, the patch density $x_2$ can be obtained by the following equation (18).

$$kx_2=\log\{(A_2/A_1)\cdot(A_1-y_{21})/(A_2-y_{22})\} \quad (18)$$

Since the constant term (Ru) is deleted in equation (18), the patch density $x_2$ can be expressed only by the incident ray intensity on the background and toner patch and the detected voltage of the reflected light, as similar to the case of black toner. Moreover, as described above, the incident ray $A_1$ and $A_2$ have been already estimated. Therefore, density at two positions: the background and the color toner patch, are measured, and relative density of the color toner patch to the background can be easily obtained on the basis of the measurement result.

According to the present embodiment, density detection in high precision becomes possible without being influenced by variation of background density.

In the above described manner, the LUT calculation unit 209 calculates an appropriate LUT on the basis of the accurately detected density of each color, and replaces contents of the LUT 2031 in the γ correction unit 203 with the evaluated value. Accordingly, density correction processing and the like can be more accurately performed. Note that the aforementioned contrast processing performed for color toner is executed for each of Y, M and C colors.

In the foregoing embodiment, an example has been given where a detected result of patch density is reflected upon γ correction. However, the present invention is not limited to the above. For instance, a calculated LUT can be reflected upon various types of tone correction control by feeding back or feeding forward the calculated LUT in each step of the image forming process, such as tone bias voltage control and the like.

<Embodiment>

Herein, descriptions will be provided for calibration of the sensor constant A, taking into consideration of variation of the sensor constant A due to declined intensity of LED emission used for the density sensor 2, or deteriorated sensitivity of a pin-type photodiode, which takes place along with the passage of time. Note that the configuration of an apparatus described below is identical to that of the above described embodiment and description thereof will be omitted.

Since the density sensor 2 utilizes an LED in the emission unit and a pin-type photodiode in the photo-reception unit, deterioration takes place in intensity of LED emission or in sensitivity of the pin-type photodiode along with the passage of time. The change appears as a variation of the sensor constant A indicative of emission intensity in equation (11). In order to perform accurate density correction, the characteristic (sensor constant A) of the density sensor 2 must be periodically checked.

Descriptions will be provided below as to how the sensor constant A is calibrated in the present embodiment.

Figure 5:
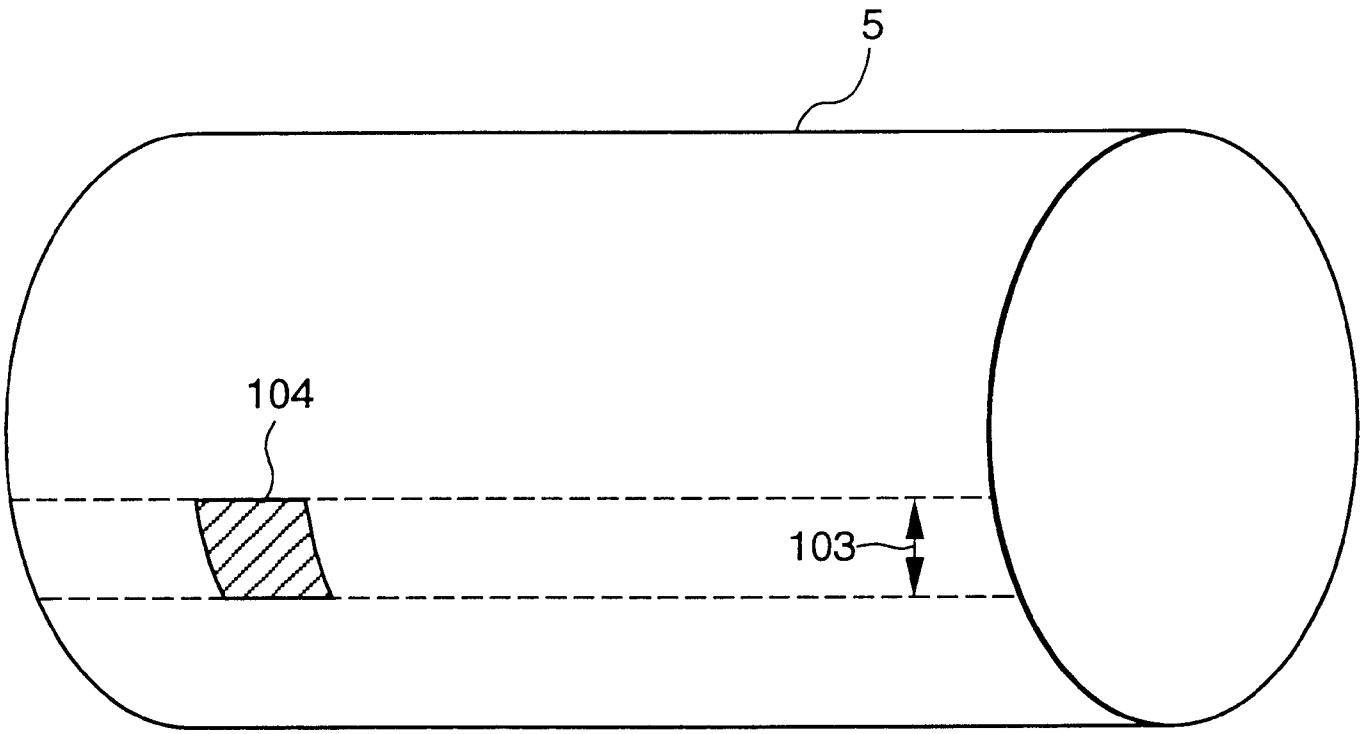
FIG. 5 is a drawing of an intermediate transfer member according to another embodiment of the present invention.
Figure 6:
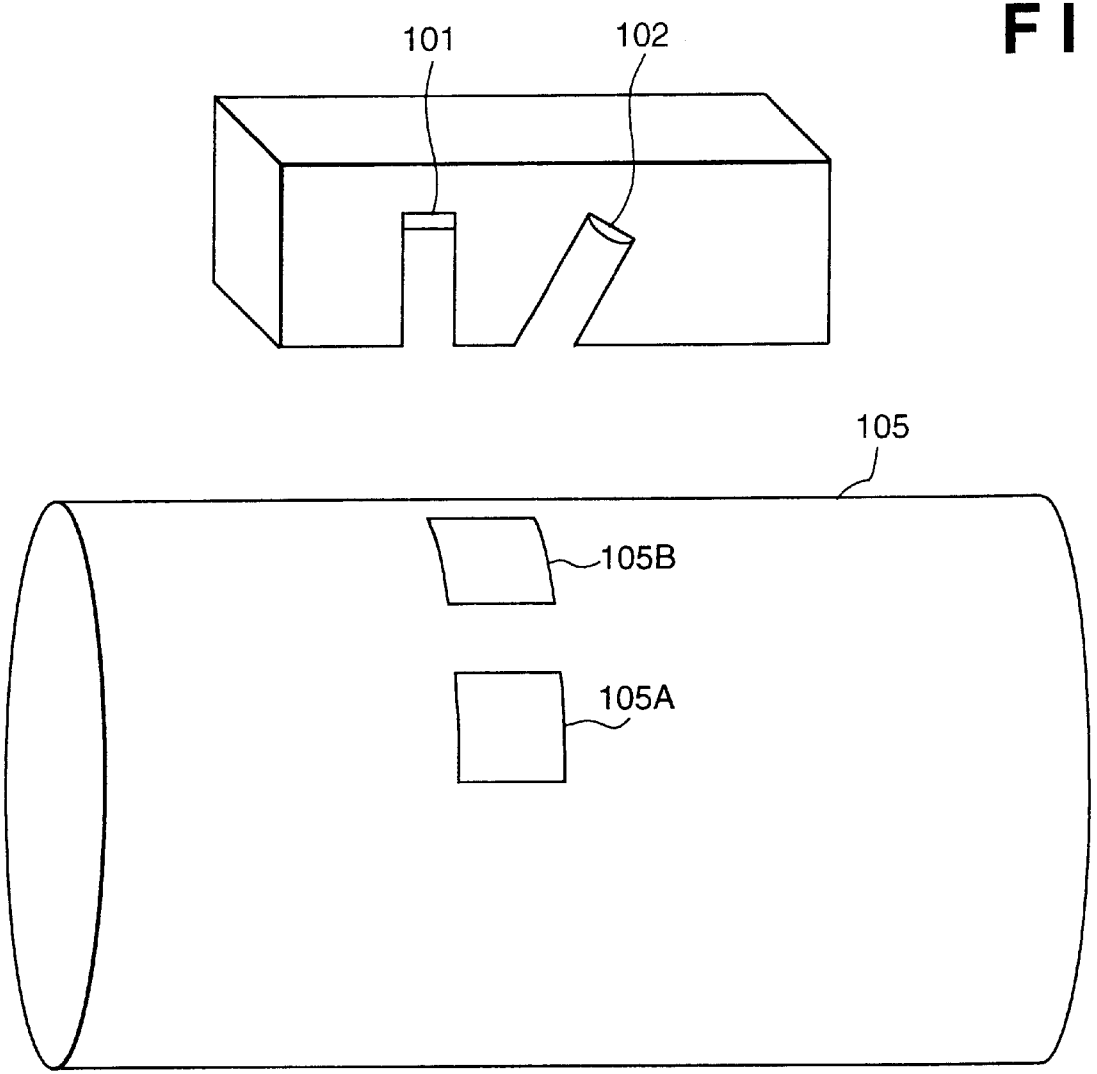
FIG. 6 is a drawing illustrating a density detection sensor as an example in a conventional color image processing apparatus.
Figure 7:
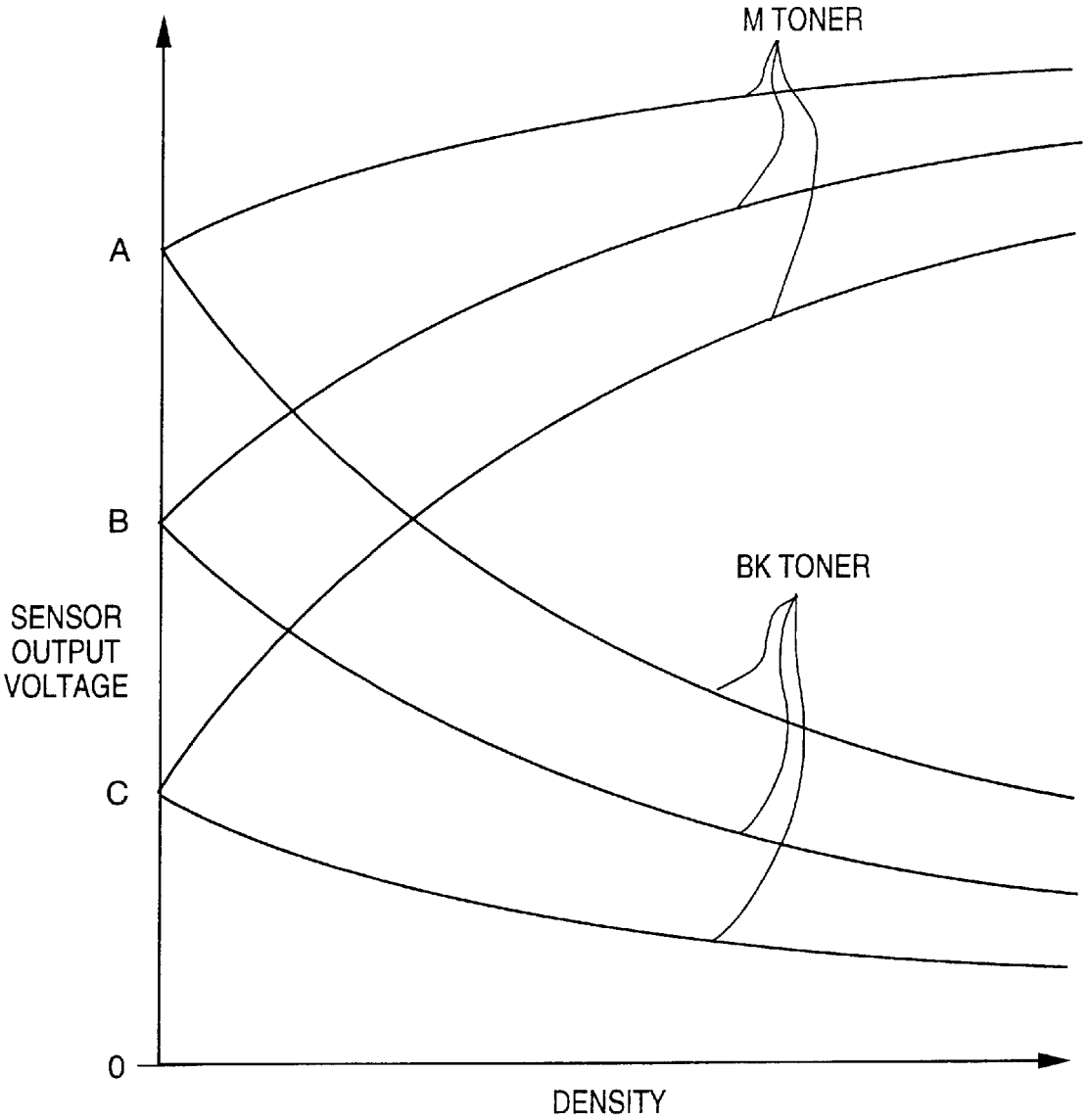
FIG. 7 is a graph showing a relationship between toner density and sensor output when density detection is performed at two positions of an intermediate transfer member, each having a different reflectivity.

FIG. 5 shows an area 104 (reference density area), representing a reference density, formed in advance in a non-printing area 103 of the intermediate transfer member 5. Since the non-printing area 103 is an area where an image is not formed, density of the surface does not change due to, for instance, remaining toner on the intermediate transfer member which cannot be completely removed by cleaning.

According to a sensor constant calibration processing of the present embodiment, the density sensor 2 first measures density of the reference density area 104 existing in the non-printing area 103 of the intermediate transfer member 5. Herein, a density value (ideal value) of the reference density area 104 is predeterminedly stored in the ROM 207. The CPU 206 compares a measured value of a density pattern formed in a printing area measured by the density sensor 2 and the ideal value stored in the ROM 207. As a result of the comparison, if the difference between the measured value and the ideal value exceeds an allowable range, i.e., more than a predetermined value, correction is made for the sensor constant A in equation (11) such that the measured value $y_1$ obtained by the equation (11) reaches closer to the ideal value. On account of the correction, the sensor constant A is corrected to an appropriate value which reflects upon an optical characteristic of the density sensor at the time of the operation.

Upon completion of the correction of the sensor constant A in the above described manner, density detection is performed in a similar manner to the foregoing embodiment and relative density of color toner is measured utilizing the corrected sensor constant A. Accordingly, stable density detection becomes possible without the influence of the variation taking place along with the passage of time in the density sensor 2, thereby it is possible to always obtain a high-quality output.

To simplify the description, only one area is provided as the reference density area 104 in the foregoing embodiment. However, it is apparent that a reference density area needs to be provided for a predetermined number of tones in all the color toner (Y toner, M toner and C toner).

The present invention can be applied to a system constituted by a plurality of devices (e.g., host computer, interface, reader, printer) or to an apparatus comprising a single device (e.g., copy machine, facsimile). Furthermore, the invention is applicable also to a case where the object of the invention is attained by supplying a program to a system or apparatus.

Further, the object of the present invention can also be achieved by providing a storage medium storing program codes for software realizing the aforementioned functions of the present embodiment to a system or an apparatus, reading the program codes with a computer (e.g., CPU, MPU) of the system or apparatus from the storage medium, then executing the program.

In this case, the program codes read out of the storage medium realize the aforementioned functions of the present embodiment, and the storage medium, storing the program codes constitutes the present invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides the aforesaid functions according to the above embodiments are realized by executing the program codes which are read by a computer, the present invention includes a case where an OS (Operating System) or the like working on the computer performs a part or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or the entire process in accordance with designations of the program codes and realizes functions of the above embodiments.

As many apparently widely different embodiments of the present invention can be made without departing from the spirit and scope thereof, it is to be understood that the invention is not limited to the specific embodiments thereof except as defined in the appended claims.

What is claimed is:

1. An image processing apparatus comprising:

generation means for generating a sensitive image on an image bearing member using color recording material and black recording material in accordance with an inputted color image signal;

transferring means for transferring the sensitive image onto a recording medium;

pattern generation means for generating a sensitive image of a reference pattern on the image bearing member using the color recording material, by utilizing said generation means;

measurement means for measuring the sensitive image of the reference pattern generated on the image bearing member and background of the image bearing member, using a sensor;

density obtaining means for obtaining density of the sensitive image based on a result of the measurement of the sensitive image of the reference pattern, a result of the measurement of the background of the image bearing member, and a constant reflecting a characteristic of the sensor; and control means for controlling an image forming condition in accordance with a density value of the sensitive image obtained by said density obtaining means.

2. The apparatus according to claim 1, wherein the sensor irradiates light on the sensitive image of the reference pattern and detects information of reflected-light from the sensitive image of the reference pattern.

3. The apparatus according to claim 1, wherein the constant reflecting the characteristic of the sensor is calculated based on a result of measuring a sensitive image of the reference pattern generated by using the black recording material, by utilizing the sensor.

4. The apparatus according to claim 1, wherein the constant reflecting the characteristic of the sensor is obtained in advance and stored.

5. The apparatus according to claim 1, wherein the constant reflecting the characteristic of the sensor is a constant indicating an irradiation intensity depending on an emitting characteristic of a light emitting device included in the sensor.

6. The apparatus according to claim 1, wherein the color recording material includes any of yellow, magenta and cyan.

7. The apparatus according to claim 1, further comprising calibration means for calibrating the constant reflecting the characteristic of the sensor based on a latent pattern image generated in an area where the color recording material or black recording material on the image bearing member does not adhere.

* * * * *

UNITED STATES PATENT AND TRADEMARK OFFICE

CERTIFICATE OF CORRECTION

PATENT NO. : 6,055,011

DATED : April 25, 2000

INVENTOR(S) : Ken Nishimura

It is certified that error appears in the above-identified patent and that said Letters Patent is hereby corrected as shown below:

COLUMN 1:

Line 57, "However" should read --However,--.

COLUMN 2:

Line 52, "largley" should read --largely--.

COLUMN 8:

Line 30, "remained" should read --remaining--;
Line 54, "is" should read --are--; and
Line 66, "is" should read --are--.

COLUMN 9:

Line 2, "accordance" should read --in accordance--;

COLUMN 11:

Line 10, "$A\text{-}y_2=A.10\text{-}(kx2+Ru)$" should read
-- $A\text{-}y_2=A.10^{-(kx2+Ru)}$ --.

UNITED STATES PATENT AND TRADEMARK OFFICE

CERTIFICATE OF CORRECTION

PATENT NO. : 6,055,011

DATED : April 25, 2000

INVENTOR(S) : Ken Nishimura

It is certified that error appears in the above-identified patent and that said Letters Patent is hereby corrected as shown below:

COLUMN 12:

Line 8, "‹Embodiment›" should read --‹Other Embodiment›--.

COLUMN 14:

Line 21, "wherein" should read --wherein the--; and
Line 22, "the (first occurrence) should be deleted.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*